US007014385B2

(12) United States Patent
Lim et al.

(10) Patent No.: US 7,014,385 B2
(45) Date of Patent: Mar. 21, 2006

(54) ATTACHMENT COUPLING DEVICE FOR HEAVY MACHINERY

(75) Inventors: Jong Hyuk Lim, Seoul (KR); Sung Chan Lee, Incheon (KR)

(73) Assignee: Hanwoo TNC Corporation, Seoul (KR)

( * ) Notice: Subject to any disclaimer, the term of this patent is extended or adjusted under 35 U.S.C. 154(b) by 0 days.

(21) Appl. No.: 10/490,446

(22) PCT Filed: Sep. 25, 2002

(86) PCT No.: PCT/KR02/01808

§ 371 (c)(1),
(2), (4) Date: Mar. 24, 2004

(87) PCT Pub. No.: WO03/027401

PCT Pub. Date: Apr. 3, 2003

(65) Prior Publication Data

US 2004/0218971 A1 Nov. 4, 2004

(30) Foreign Application Priority Data

Sep. 26, 2001 (KR) ..... 2001-59555
Dec. 28, 2001 (KR) ..... 20-2001-0040537

(51) Int. Cl.
*F16D 1/00* (2006.01)

(52) U.S. Cl. ..... 403/322.4; 403/321; 403/322.1; 403/322.3; 403/324; 37/468; 37/903; 172/272; 414/723

(58) Field of Classification Search ..... 403/321, 403/322.1, 322.3, 322.4, 324; 37/468, 903; 172/272; 414/705, 723
See application file for complete search history.

(56) References Cited

U.S. PATENT DOCUMENTS

| | | | | |
|---|---|---|---|---|
| 5,107,610 | A * | 4/1992 | Fusco | 37/444 |
| 5,125,788 | A * | 6/1992 | Stenger | 414/723 |
| 5,546,683 | A * | 8/1996 | Clark | 37/468 |
| 6,231,296 | B1 * | 5/2001 | Blomgren | 414/723 |
| 6,241,455 | B1 * | 6/2001 | Schupback et al. | 414/723 |
| 6,332,747 | B1 * | 12/2001 | Lee | 414/723 |

FOREIGN PATENT DOCUMENTS

KR 98-63058 11/1998

* cited by examiner

*Primary Examiner*—Daniel P. Stodola
*Assistant Examiner*—Michael P. Ferguson
(74) *Attorney, Agent, or Firm*—Lowe Hauptman & Berner, LLP

(57) ABSTRACT

An attachment coupling device is designed to releasably connect a variety of attachments to an arm and a push link of heavy machinery such as hydraulic excavators. The attachment coupling device comprises a pair of mounting brackets fixedly secured to the attachment, each bracket having first and second hooks spaced apart with each other. Another major element of the coupling device is a coupler which includes, a fixed plate affixed to the arm and the push link, a pair of fixed coupling pins each protruding outwardly from the fixed plate for engagement with the first hook of each of the mounting brackets, a pair of movable coupling pins for movement between a retracted release position and an extended coupling position wherein the respective one of the movable pins comes into engagement with the second hook of each of the mounting brackets, and an actuator for causing movement of the movable coupling pins.

3 Claims, 15 Drawing Sheets

ATTACHMENT COUPLING DEVICE FOR HEAVY MACHINERY

TECHNICAL FIELD

The present invention is generally directed to heavy machinery and, more specifically to an attachment coupling device for detachably connecting a variety of attachments to an arm of excavators.

BACKGROUND ART

Excavators for use in construction or engineering work sites are adapted to perform a variety of works, such as bucket-used ground excavation, building crush and steel rod cutting through the use of a crusher, breakdown of rocks and concrete by use of a breaker, and transportation of scrap steel and rocks by virtue of a grab. The attachments employed in the excavators are changed with another one, depending on the work situations.

Such attachments are releasably mounted onto an arm of excavators so that they can be changed with other type of attachments with ease, if necessary. Referring to FIG. 1, in which a bucket is illustrated as an example of the attachments, it will be seen that the bucket 1 is provided with a pair of spaced-apart, parallel, supporting brackets 3, each of which has coupling holes 3*a*. An arm 5 and a push link 7 of the excavators are disposed between the pair of supporting brackets 3, and the coupling holes 3*a* of the supporting brackets 3 are aligned with fastening holes 5*a*, 7*a* of the arm 5 and the push link 7, respectively. With such a configuration, the arm 5 and the push link 7 of the excavators are caused to be placed between the pair of supporting brackets 3 and the coupling holes 3*a* of the supporting brackets 3 are aligned with the fastening holes 5*a*, 7*a* of the arm 5 and the push link 7. Moreover, a couple of connecting pins 8 are fitted into the aligned coupling holes 3 and fastening holes 5*a*, 7*a* to attach the bucket to the arm and the push link. In this manner, the bucket 1 is releasably mounted to the excavators.

However, the conventional attachment coupling structure requires cumbersome and laborious coupling operations in that an operator should align the fastening holes 5*a*, 7*a* of the arm 5 and the push link 7 of the excavators with the coupling holes 3*a* of the bucket 1 and then fit the connecting pins 8 into the aligned fastening holes 5*a*, 7*a* and coupling holes 3*a* one by one in order to attach the bucket to the arm and the push link. Particularly, an assistant operator should positively take part in checking the alignment state of the fastening holes 5*a*, 7*a* with the coupling holes 3*a* one by one in the alignment process. The transportation and handling of the attachments, the connecting pins and the like is difficult due to their heavyweight nature. And, at the end of coupling operation of the connecting pins, it is necessary to strongly strike the connecting pins by use of a hammer, for instance, thus assuring complete and safe coupling of the attachments. This may lead to waste of time and manpower.

Recently, in view of the above-noted drawbacks, there has been developed and used an attachment coupling device whereby the attachments can be readily connected to the arm of the excavators. As an example, FIG. 2 shows a prior art coupling device disclosed in Korean Laid-Open Utility Model Publication No. 98-63058. The coupling device 10 has a body 12 of which upper portions are formed with a pair of opposite fastening plates 13. Fixing holes 13*a* are formed at both sides of each of the fastening plates 13 in an aligned relationship with each other. In the meantime, the arm 5 and the push link 7 of the excavator are disposed between the pair of fastening plates 13, and the fixing holes 13*a* of the fastening plates 13 are aligned with the fastening holes 5*a*, 7*a* of the arm 5 and the push link 7 of the excavator. Connecting pins 15 are fixedly fitted into the aligned fixing holes 13*a* and fastening holes 5*a*, 7*a*. In such a way, the attachment coupling device 10 is firmly affixed to the excavator.

Meanwhile, a fixed hook 20 and a movable hook 30 are mounted on each side of the bottom of the body 12 in a spaced-apart opposing relationship with each other. Each of the fixed hooks 20 is formed integrally with the body 12 and has an engagement recess 22 capable of being engaged with a first connecting pin 9*a* formed at the bucket 1. Further, each of the movable hooks 30 is adapted to rotate about a hinge shaft 30*a* between a "coupling position" A and a "release position" B, and has an engagement recess 32 capable of being engaged with a second connecting pin 9*b* formed at the bucket 1. The movable hook 30 is so constructed as to be fixed to the body 12 by means of a fixing pin 34 at the "coupling position" A.

A hydraulic cylinder 40 for causing each of the movable hooks 30 to rotate is mounted to the body 12. The hydraulic cylinder 40 consists of a cylinder housing 42 and a cylinder rod 44. The cylinder housing 42 is affixed to the body 12 through a pivot pin 42*a*, whereas the cylinder rod 44 is secured to one side portion of the movable hook 30 through a pivot pin 44*a*. The hydraulic cylinder 40 can be extended or retracted by means of hydraulic fluid to cause the movable hook 30 either to rotate from the "coupling position" A into the "release position" B or from the "release position" B into the "coupling position" A.

The operation of the prior art attachment coupling device constructed as such will be described below. First, under the state that the attachment coupling device 10 is affixed to the arm 5 and the push link 7 of the excavator, the hydraulic cylinder 40 is retracted to cause the movable hook 30 to be placed at the "release position" B. Then, the first connecting pin 9*a* is caught by the fixed hook 20 so that the first connecting pin 9*a* of the bucket 1 is engaged with the engagement recess 22 of the fixed hook 20. Thereafter, the attachment coupling device 10 is caused to rotate by the combined action of an arm cylinder 7*b* and the push link 7 of the excavator so that the engagement recess 32 of the movable hook 30 becomes aligned with the second connecting pin 9*b* of the bucket 1. Once the engagement recess 32 of the movable hook 30 is aligned with the second connecting pin 9*b* of the bucket 1, the hydraulic cylinder 40 is caused to extend so that the movable hook 30 is placed at the "coupling position" A. At this time, as the movable hook 30 is placed at the "coupling position" A, the engagement recess 32 of the movable hook 30 will come into engagement with the second connecting pin 9*b* of the bucket 1. In this state, the bucket 1 is mounted to the arm 5 of the excavator and the movable hook 30 is affixed to the body 12 by using the fixing pin 34 so as to prevent movement of the movable hook 30.

Although the above-referenced attachment coupling device 10 has an advantage in that attachments such as a bucket can be quickly and conveniently connected to or detached from the excavator, one important drawback remains unresolved that an operator himself should affix the movable hook 30 to the body 12 by using the fixing pin 34.

Furthermore, the distance between the first and second connecting pins 9*a*, 9*b* of the bucket 1, i.e., pin-to-pin distance, varies depending on the kinds of attachments, and the "coupling position" A of the movable hook 30 may vary accordingly in the prior art device. This poses a problem that the movable hook 30 cannot be affixed to the body 12 by use of the fixing pin 34. If the excavator is driven in this condition, there is a risk that the attachment may be unwantedly detached from the arm of the excavator. A further shortcoming lies in that, as concentrated load is exerted on the hydraulic cylinder 40, the hydraulic cylinder 40 becomes retracted by itself, which results in the attachment being accidentally detached from the arm of the excavator.

In a case where the hydraulic fluid supplied to the hydraulic cylinder 40 leaks out during the course of operation, an accident may arise that the attachment is dropped from the attachment coupling device 10. That is, if the hydraulic fluid supplied to the hydraulic cylinder 40 leaks out, the hydraulic cylinder 40 loses its extension force and the work load exerted on the movable hook 30 is concentrated on the fixing pin 34, which would lead to breakage of the fixing pin 34. Such breakage of the fixing pin 34 will cause the movable hook 30 to move into the "release position" B, as a result of which the attachment 1 becomes disengaged from the fixed hook 20 and thus detached from the excavator.

In addition to the above, the conventional attachment coupling device is disadvantageous in that the radius of rotation of the bucket 1 is too great.

That is, as shown in FIG. 2, mainly because the bucket 1 is designed to rotate about the connecting pin 15 which remains spaced apart from the first connecting pin 9*a* of the bucket 1, the radius of rotation of the bucket 1 is increased (R1<R2), as compared with FIG. 1 in which the bucket 1 is connected directly to the arm 5 of the excavator. As a result, when the arm 5 of the excavator is retracted, there is a possibility that the bucket 1 may come into collision with a main body of the excavator. The reduced radius of rotation of the bucket 1 may also be a culprit in weakening the excavating force of the bucket.

SUMMARY OF THE INVENTION

With the afore-mentioned problems inherent in the prior art taken into account, it is an object of the present invention to provide an attachment coupling device for such heavy machinery as excavators that allow an operator to quickly and conveniently connect attachments to the heavy machinery.

Another object of the present invention is to provide an attachment coupling device for such heavy machinery as excavators capable of positively preventing attachments from unwanted detaching from the heavy machinery.

A further object of the present invention is to provide an attachment coupling device for heavy machinery that can reduce the radius of rotation of the attachments and, at the same time, increase the excavating force of the attachments.

According to the present invention, there is provided an attachment coupling device for connecting an attachment to an arm and a push link of heavy machinery, comprising: a pair of mounting brackets spaced apart from each other and fixedly secured to the attachment, each of the mounting brackets having first and second hooks that are aligned on an identical vertical plane; and a coupler including a pair of fixed plates secured to the arm and the push link, a pair of fixed coupling pins protruding outwardly from the fixed plates in a manner that the fixed coupling pins can be caught by the first hooks of the mounting brackets, a pair of movable coupling pins fitted to the fixed plates for linear movement between a release position and a coupling position in which the movable coupling pins come into engagement with the second hooks of the mounting brackets, and an actuator for causing the linear movement of the movable coupling pins.

BEST MODE FOR CARRYING OUT THE INVENTION

Preferred embodiments of an attachment coupling device for heavy machinery according to the invention will now be described in detail with reference to the accompanying drawings.

Figure 1:
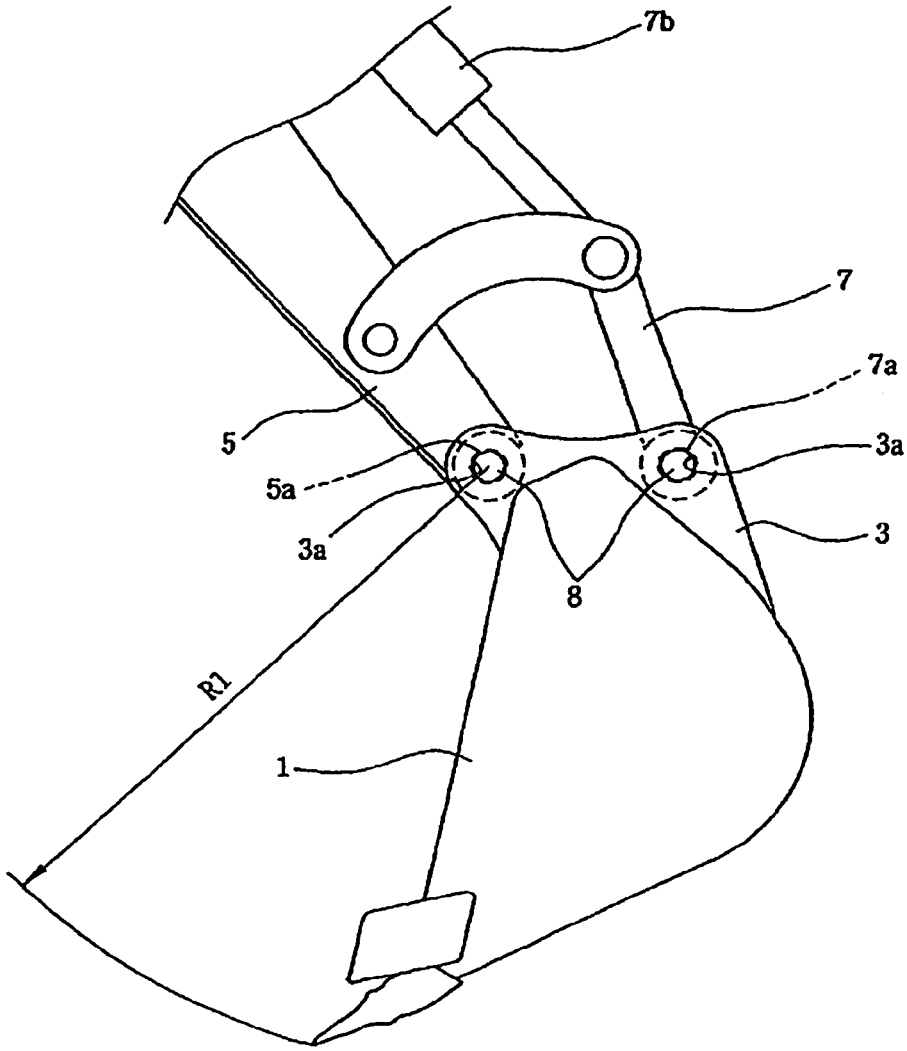
Fig. 1 (PRIOR ART)
FIG. 1 is a side view illustrating a conventional attachment mounting method, according to which an attachment is connected directly to an arm of heavy machinery.
Figure 2:
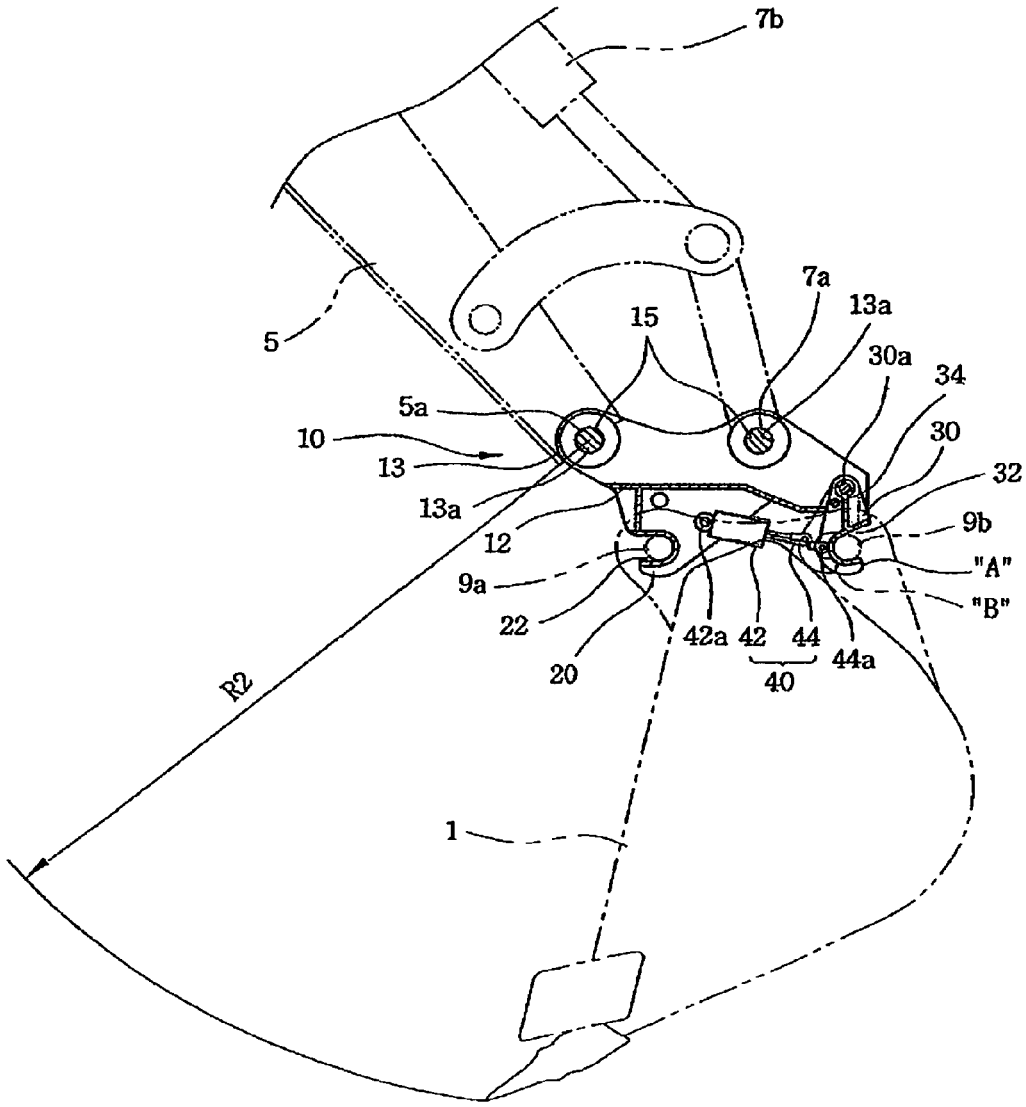
Fig. 2 (PRIOR ART)
FIG. 2 is a partially cut away sectional view showing the configuration of a prior art attachment coupling device for heavy machinery.
Figure 3:
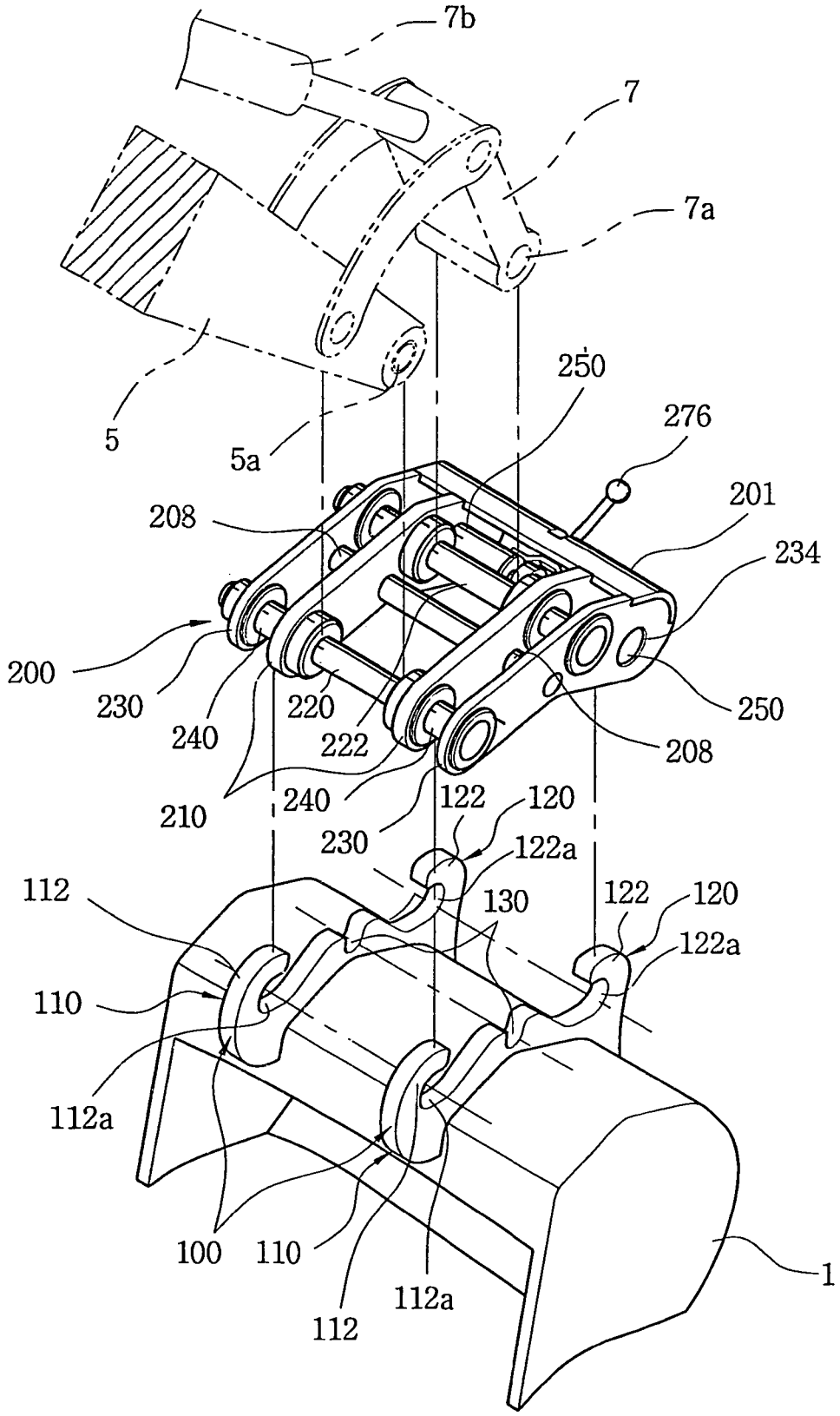
FIG. 3 is an exploded perspective view showing the configuration of an attachment coupling device for heavy machinery according to the invention.

Referring first to FIG. 3, it can be understood that the attachment coupling device of the present invention comprises a pair of mounting brackets 100 affixed to a bucket 1, and a coupler 200 secured to an arm 5 of an excavator.

Figure 5:
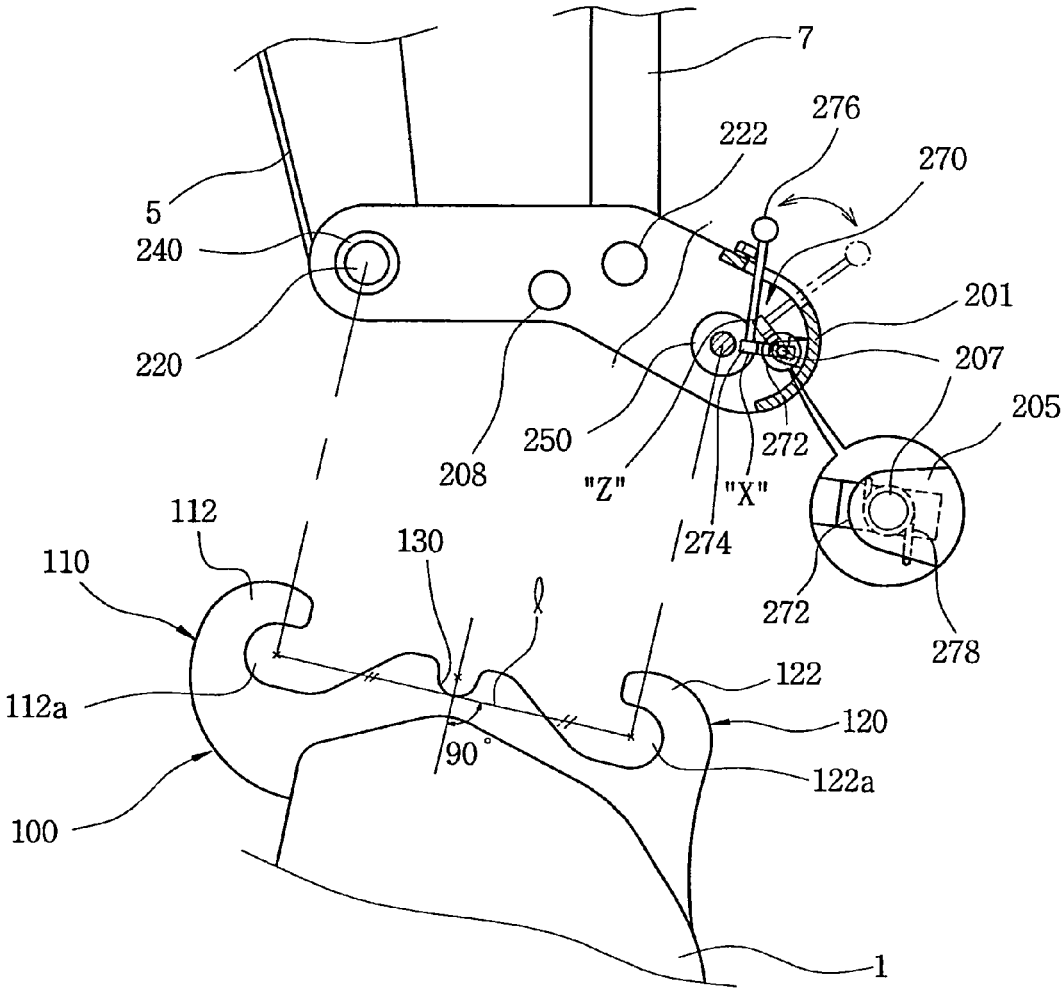
FIG. 5 is a sectional view taken along line V—V in FIG. 4.

Each of the mounting brackets 100 has first and second coupling portions 110, 120 which are spaced apart from each other, fixedly placed side by side on a top surface of the bucket 1 and aligned on an identical vertical plane. Each of the first and second coupling portions 110, 120 includes first and second hooks 112, 122. The first and second hooks 112, 122 are constructed to face each other at opposite sides of each of the mounting brackets 100, and have engagement recesses 112*a*, 122*a* that are open inwards in a mutually confronting relationship with each other. Further, each of the mounting brackets 100 has a positioning recess 130 that is open upwards and formed on a symmetry line between the first and second hooks 112, 122. As the positioning recess 130 is formed on the symmetry line between the first and second hooks 112, 122, the first and second hooks 112, 122 are placed so that they can be symmetric with each other with respect to the positioning recess 130. In other words, as shown in FIG. 5, the positioning recess 130 is placed on a normal line intersecting a center of a connecting line l for connecting centers of the engagement recesses 112*a*, 122*a* of the first and second hooks 112, 122. Meanwhile, as the pair of mounting brackets 100 are placed side by side as shown in FIG. 3, it will be apparent that the engagement recesses 112*a*, 122*a* and the positioning recess 130 are aligned in a confronting relationship with one another.

Figure 10:
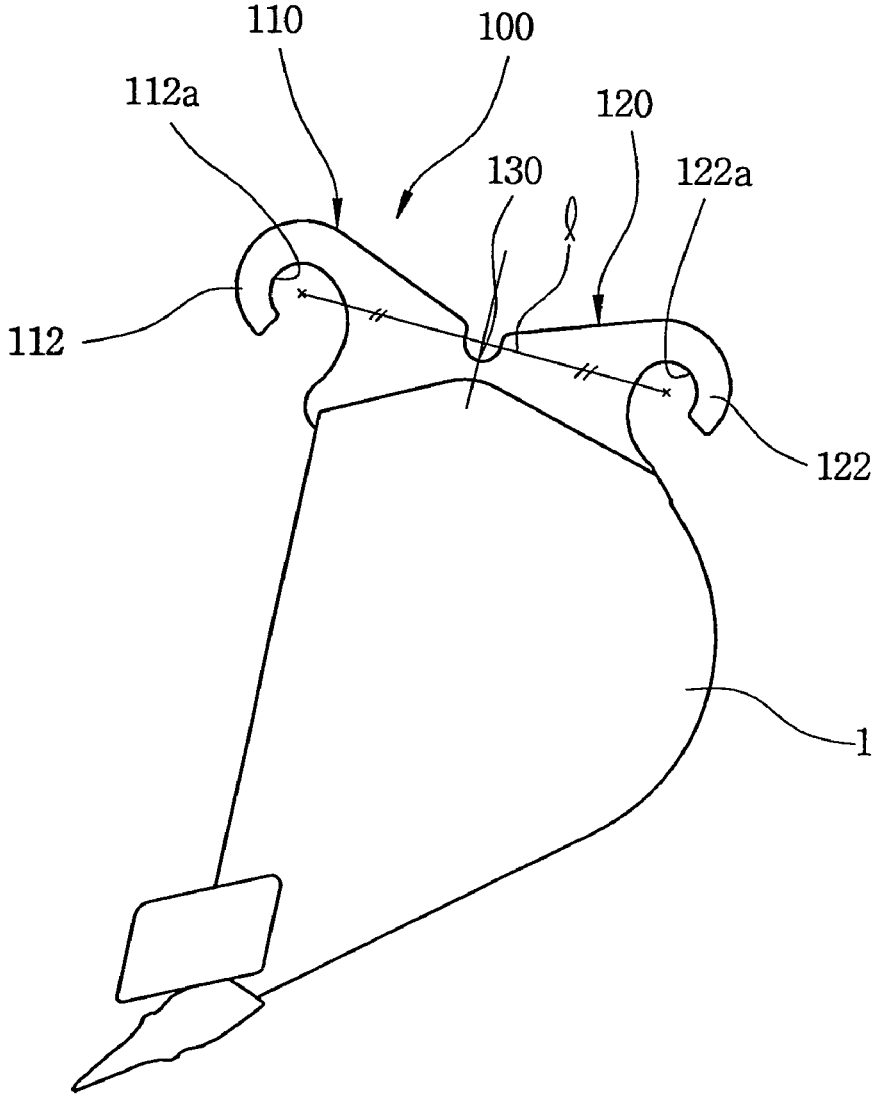
FIG. 10 is a side view showing a modified example of a mounting bracket constituting the attachment coupling device according to the invention.

Although the first and second hooks 112, 122 of each of the mounting brackets 100 are constructed to face each other as shown in FIG. 5, it would be also possible to construct the hooks to lie with each other at their backs as shown in FIG. 10. In this case, the engagement recesses 112*a*, 122*a* of the first and second hooks 112, 122 should be open outwards.

Figure 4:
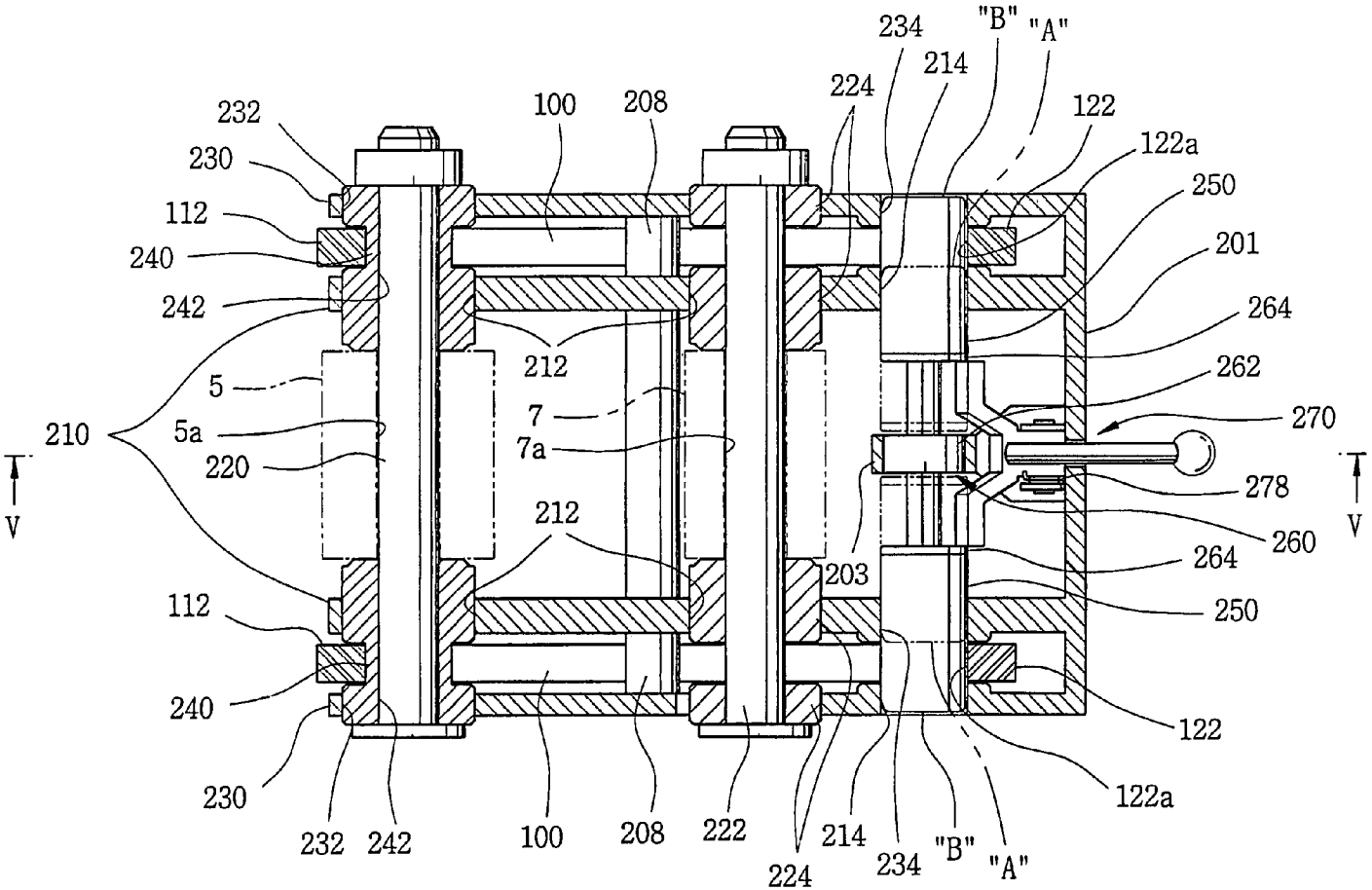
FIG. 4 is a top sectional view of a coupler constituting the attachment coupling device according to the invention.

Referring next to FIG. 3, the coupler 200 includes a pair of fixed plates 210 disposed side by side in a spaced-apart relationship with each other. The fixed plates 210 are affixed to the arm 5 and the push link 7 of the excavator, and have first and second connecting pins 220, 222 fitted into fastening holes 5*a*, 7*a* of the arm 5 and the push link 7, respectively. The first and second connecting pins 220, 222 are fitted into fixing holes 212 formed in the fixed plates 210 as shown in FIG. 4. As the first and second connecting pins are fitted into the fixing holes 212 of the fixed plates 210 and the fastening holes 5*a*, 7*a* of the arm 5 and the push link 7, which are aligned with one another, the pair of the fixed plates 210 can be fixedly secured to the arm 5 and the push link 7 of the excavator. The first and second connecting pins 220, 222 are constructed such that both ends of each of the connecting pins penetrate the fixed plates 210 and fastening plates 230 as set forth later. Fixed coupling pins 240, which will be described in detail later, are disposed between the first connecting pin 220 and the fixed plates 210 and between the first connecting pin 220 and the fastening plates 230. Sleeves 224 are disposed between the second connecting pin 222 and the fixed plates 210 and between the second connecting pin 222 and the fastening plates 230.

Referring again to FIG. 3, the coupler 200 of the present invention has the pair of fastening plates 230 each of which is spaced apart from one side of one of the fixed plates 210. The fastening plates 230 have the same shape as the fixed plates 210 and are secured to the fixed plates 210 with an interval left therebetween by means of a connecting plate 201 at one side of the fastening plates 210. Further, each of the fastening plates 230 is constructed to lie together with the relevant fixed plate 210 on opposite sides of each of the mounting brackets 100 of the bucket 1. As the fixed plate 210 and the fastening plate 230 lie on the opposite sides of each of the mounting brackets 100, the mounting bracket 100, especially the first and second hooks 112, 122 of the mounting bracket 100 are placed between the fixed plate 210 and the fastening plate 230.

Figure 8A:
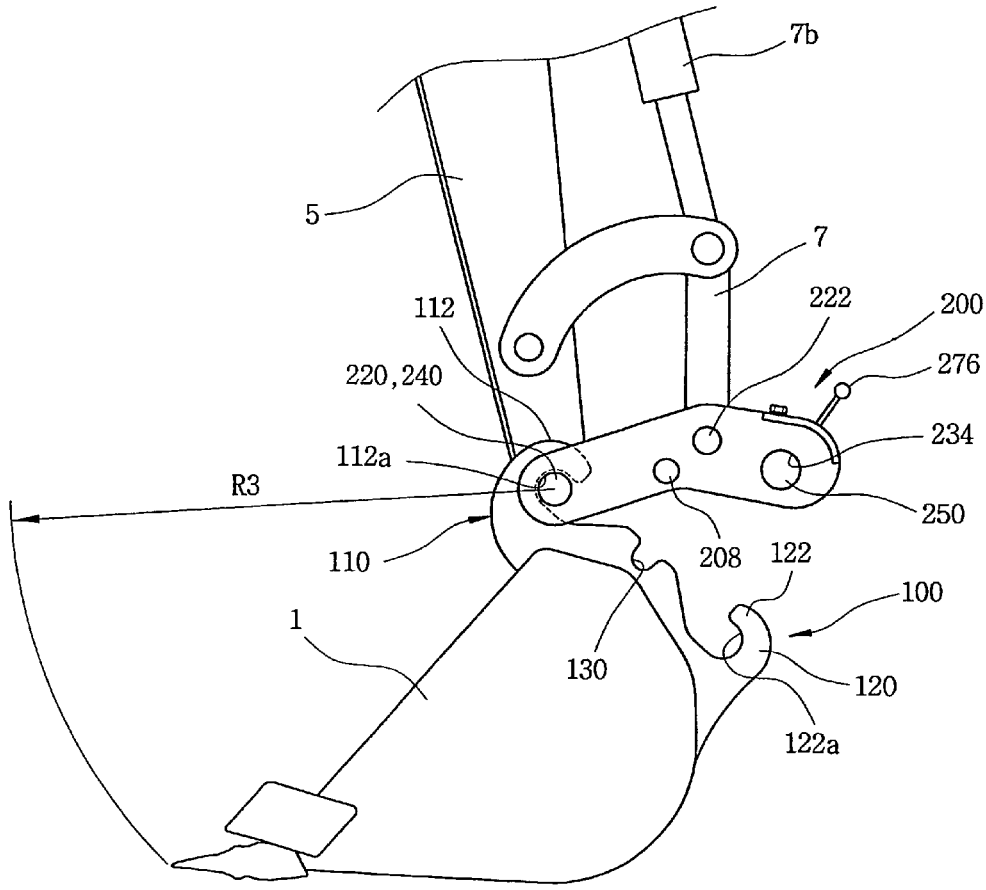
FIGS. 8A and 8B are side views illustrating how to use the attachment coupling device according to the invention.
Figure 8B:
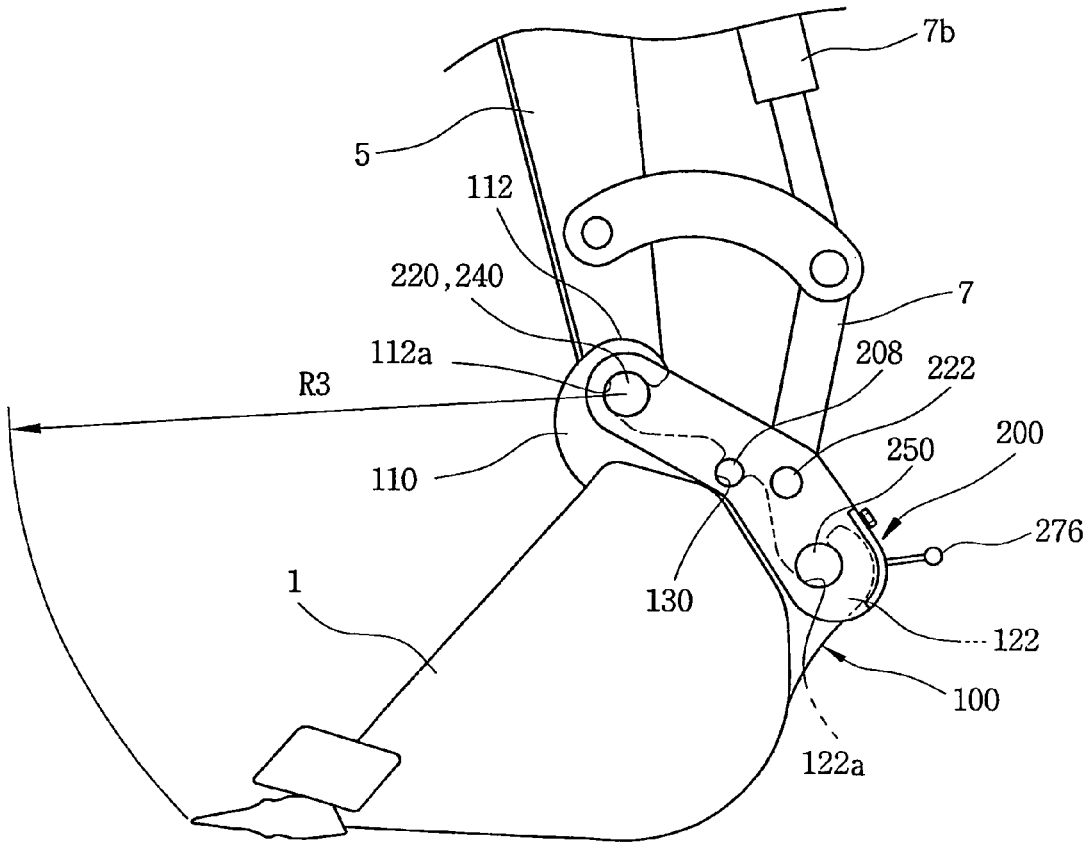

The pair of fixed coupling pins 240, which is to be caught by the first hooks 112 of the mounting brackets 100, are fixedly installed between the fixed plates 210 and the fastening plates 230. The fixed coupling pins 240 are constructed to be fixedly fitted into the fixing holes 212 formed in the fixed plates 210 and assembly holes 232 formed in the fastening plates 230, as shown in FIG. 4. It will be appreciated that the fixed coupling pins 240 are coaxial with the first connecting pin 220 coupled to the arm 5 of the excavator. To this end, an axial bore 242 is formed at the center of each of the fixed coupling pins 240, and the first connecting pin 220 is fitted into the axial bore 242 to penetrate therethrough. The reason why the fixed coupling pins 240 and the first connecting pin 220 are kept coaxial with each other in this way is that the radius of rotation R3 of the bucket 1 can be reduced by coaxially disposing the first connecting pin 220 with the center of rotation of the bucket 1 and the fixed coupling pins 240 with the connection points of the coupler 200 and the bucket 1, as shown in FIG. 8B.

Referring again to FIG. 4, coupling holes 214, 234 are formed, at the other sides of the fixed coupling plates 210 and the fastening plates 230 to penetrate therethrough. A pair of movable coupling pins 250 are disposed in the coupling holes 214, 234 so that the movable coupling pins can reciprocate between a "release position" A and a "coupling position" B.

The coupling holes 214, 234 are aligned with the engagement recesses 122*a* of the second hooks 122 of the mounting brackets 100, which are disposed between the fixed plates 210 and the fastening plates 230. The movable coupling pins 250 are constructed to be fitted from inner sides of the fixed plates 210 into the coupling holes 214, 234 of the fixed and fastening plates 210, 230. The movable coupling pins 250 are selectively inserted into the engagement recesses 122*a* of the second hooks 122 while reciprocating between the "release position" A and the "coupling position" B along the coupling holes 214, 234. The "release position" A corresponds to a position wherein the movable coupling pins 250 move to inner sides of the fastening plates 230 and thus are disengaged from the engagement recesses 122*a* of the second hooks 122. The "coupling position" B corresponds to a position wherein the movable coupling pins 250 are simultaneously fitted into the coupling holes 214, 234 of the fixed and fastening plates 210, 230 and thus are inserted into the engagement recesses 122*a* of the second hooks 122.

Meanwhile, the coupler 200 of the present invention includes an actuator 260 for causing the pair of movable coupling pins 250 to reciprocate. The actuator 260 is a "double-acting hydraulic cylinder" of the type capable of simultaneously moving the pair of movable coupling pins 250. The actuator includes a rod member 262 affixed to the connecting plate 201 through a fixed bracket 203, and cylinder housings 264 extendably and retractably disposed at opposite ends of the rod member 262. In the present invention, the cylinder housings 264 and the movable coupling pins 250 are formed integrally with each other so that the cylinder housings 264 can simultaneously perform the function of the movable coupling pins 250. The following description will be made by designating the cylinder housings 264 and the movable coupling pins 250 with the same reference numeral "250" for the sake of convenience.

The actuator 260 is extended or retracted by means of the hydraulic fluid supplied from a pressurized fluid source of the excavator to cause the movable coupling pins 250 to reciprocate from the "release position" A into the "coupling position" B or from the "coupling position" B into the "release position" A. Particularly, the actuator functions to cause the movable coupling pins 250 to be selectively engaged with the engagement recesses 122*a* of the second hooks 122 by moving the movable coupling pins 250 from the "release position" A into the "coupling position" B and vice versa.

Although a hydraulic cylinder is employed as the actuator 260 for moving the movable coupling pins 250 in the illustrated embodiment, the present invention is not limited thereto. For example, the movable coupling pins 250 may be moved by using a pneumatic cylinder, a screw mechanism, or a cam mechanism and so on.

Figure 6:
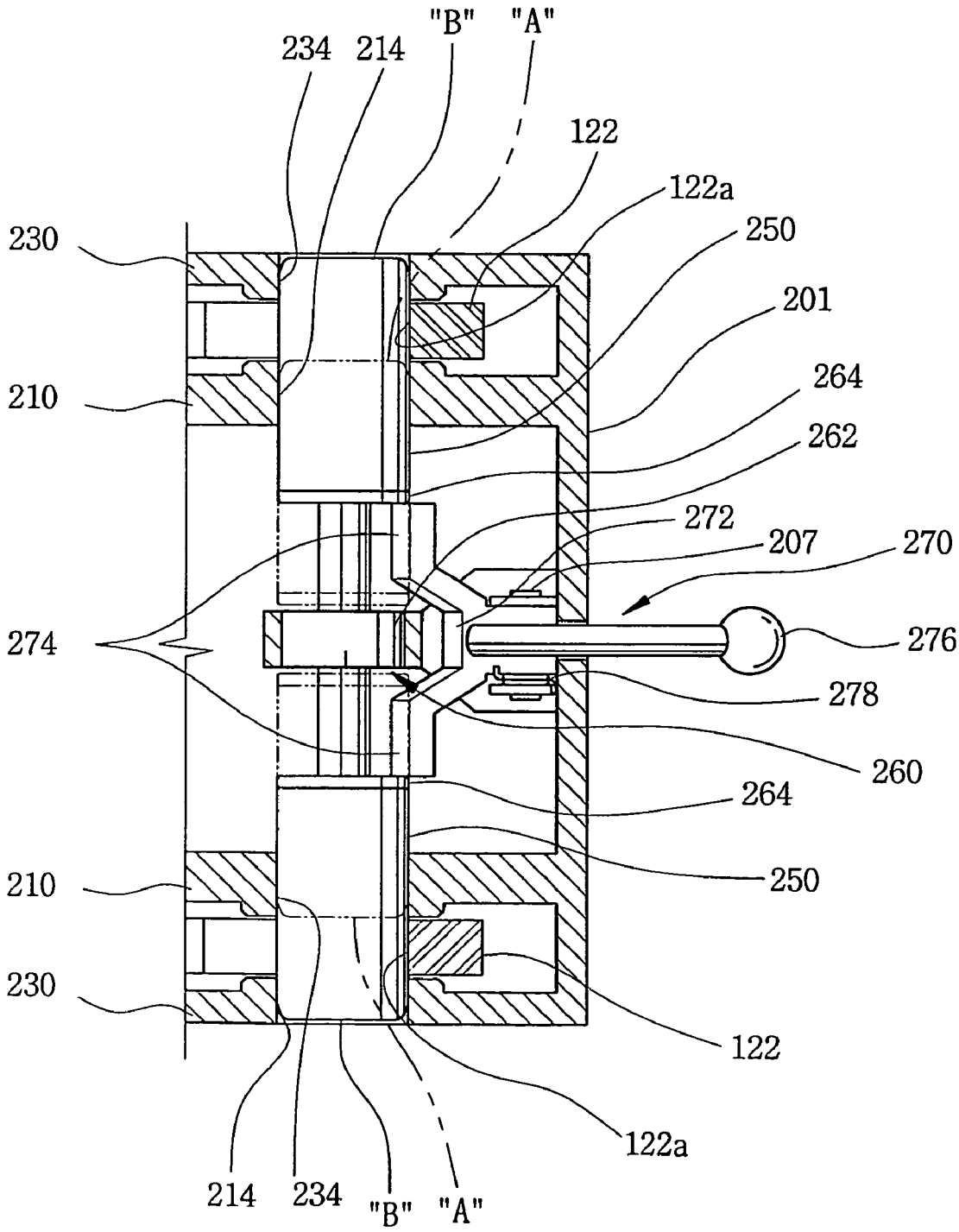
FIG. 6 is a top sectional view of a lock constituting the attachment coupling device according to the invention.

The coupler 200 of the invention is provided with a lock 270 for locking the movable coupling pins 250 at the "coupling position" B. As shown in FIGS. 5 and 6, the lock 270 includes a rotary body 272 rotatable about a hinge shaft 207 between a locked position" X and a "release position" Z, a pair of stoppers 274 extending from opposite sides of the rotary body 272 as shown in FIG. 6, and a lever 276 penetrating the connecting plate 201 and extending outwardly from the coupler 200 to allow rotation of the rotary body 272.

The stoppers 274 are constructed to support rear portions of the movable coupling pins 250, which have been moved to the "coupling position" B as shown in FIG. 6, when the rotary body 272 is placed at the "locked position" X as shown in FIG. 5. Thus, the stoppers 274 prevent the movable coupling pins 250 from moving out of the "coupling position" B into the "release position" A. Further, the lever 270 allows an operator to turn the rotary body 272 from the "locked position" X into the "release position" Z or from the "release position" Z into the "locked position" X, so that the stoppers 274 can be selectively placed within the moving trajectories of the movable coupling pins 250. Meanwhile, the lock 270 is urged toward the "locked position" X by a torsion spring 278 of which both ends are supported by a hinge bracket 205 and the rotary body 272 as shown in FIG. 5. This is to cause the stoppers 274 to always hold the movable coupling pins 250 at the "coupling position" B in order to prevent the movable coupling pins 250 from escaping out of the engagement recesses 122*a* of the second hooks 122 even though the actuator 260 is retracted or broken at the "coupling position" B.

Figure 7:
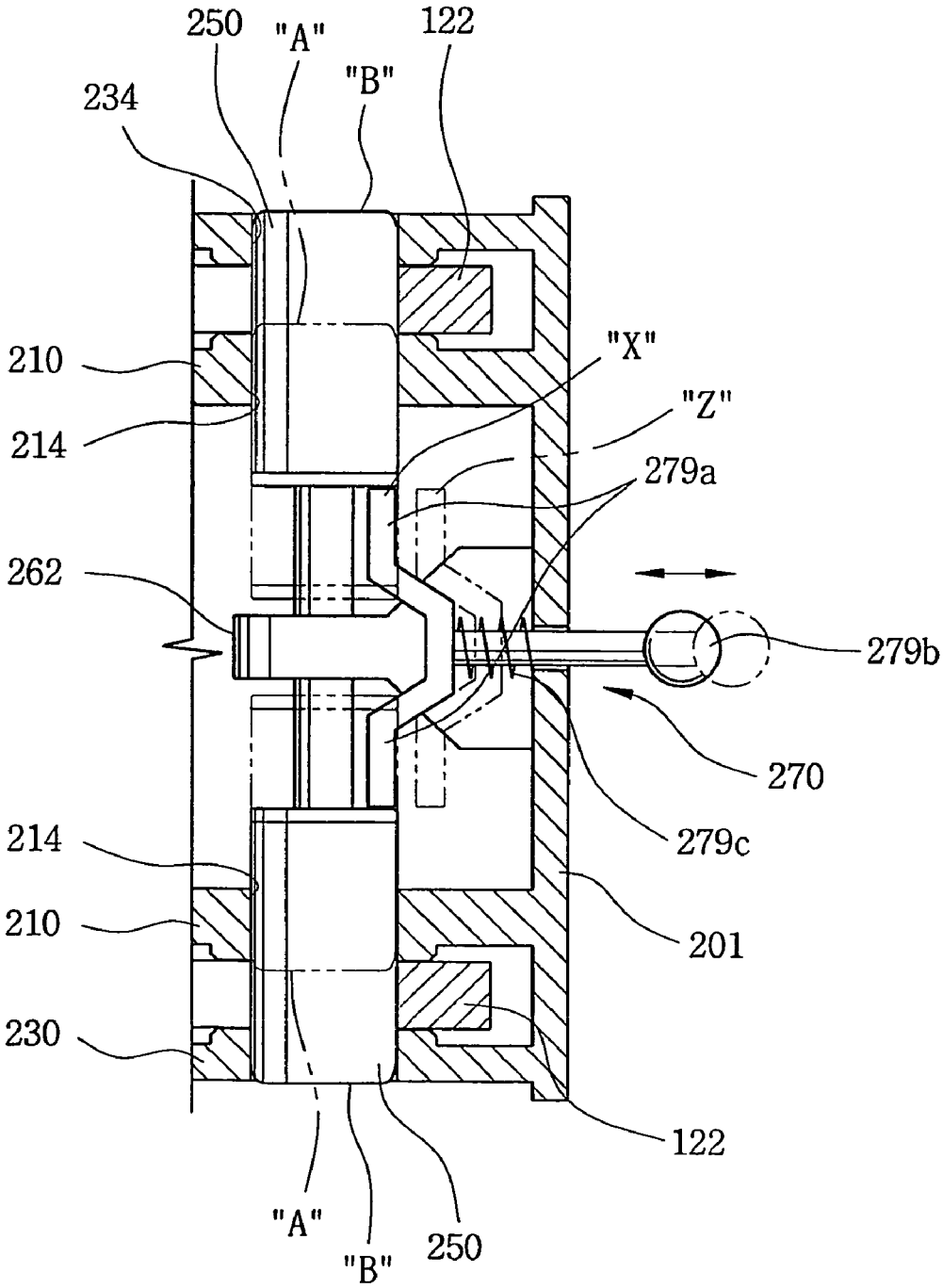
FIG. 7 is a top sectional view of a modified example of the lock constituting the attachment coupling device according to the invention.

FIG. 7 shows a modified example of the lock 270. The lock 270 of the modified example includes a pair of stoppers 279*a* capable of supporting the rear portions of the movable coupling pins 250, a lever 279*b* for causing the stoppers 279*a* to reciprocate from the "locked position" X into the "release position" Z or from the "release position" Z into the "locked position" X, and a compression spring 279*c* of which one end is supported by the stoppers 279*a* and the other end is supported by the connecting plate 201 so that the stoppers 279*a* are placed at the "locked position" X. In the lock 270 of the modified example, the lever 279*b* is pulled or pushed to cause the stoppers 279*a* to be selectively placed at the "locked position"X, so that the movable coupling pins 250 are selectively locked at the "coupling position" B.

Turning back to FIG. 3, the coupler 200 is provided with a pair of positioning pins 208 which are to be engaged with the positioning recesses 130 of the mounting brackets 100. The positioning pins 208 are coaxially secured between the fixed and fastening plates 210, 230 as shown in FIG. 4. Particularly, in the present invention, the pair of positioning pins 208 are constructed in the form of a single long pin which is secured across the fixed and fastening plates 210, 230.

Such positioning pins 208 are engaged with the positioning recesses 130 of the mounting brackets 100 as shown in FIG. 3 and thus function to increase the coupling force of the bucket 1 and the coupler 200. Particularly, the positioning pins 208 are first engaged with the positioning recesses 130 of the mounting brackets 100 during a process of causing the coupler 200 to rotate as shown in FIG. 8B after the fixed coupling pins 240 of the coupler 200 are caught by the first hooks 112 of the mounting brackets 100 as shown in FIG. 8A. Thus, the positioning pins serve to smoothly align the coupling recesses 122*a* of the second hooks 122 with the movable coupling pins 250 of the coupler 200.

Description on how to use the attachment coupling device according to the present invention constructed as such will be made with reference to FIGS. 4 and 5 and FIGS. 8A and 8B. First, as shown in FIG. 8A, the fixed coupling pins 240 of the coupler 200 are caught by the first hooks 112 of the mounting brackets 100 installed on the bucket 1 under the state that the coupler 200 is affixed to the arm 5 and the push link 7 of the excavator. As the fixed coupling pins 240 of the coupler 200 are caught by and engaged with the first hooks 112, the mounting brackets 100 are smoothly disposed between the fixed and fastening plates 210, 230 of the coupler 200, as shown in FIG. 4.

In such a state, the coupler 200 is slowly rotated by using the arm cylinder 7*b* and the push link 7 of the excavator as shown in FIG. 8B. Then, as shown in FIG. 4, the second hooks 122 of the mounting brackets 100 are disposed between the fixed and fastening plates 210, 230 of the coupler 200. Accordingly, the coupling holes 214, 234 of the fixed and fastening plates 210, 230 are smoothly aligned with the engagement recesses 122*a* of the second hooks 122. While causing the coupler 200 to rotate, the positioning pins 208 of the coupler 200 are first engaged with the positioning recesses 130 of the mounting brackets 100 as shown in FIG. 8B. This assures that the engagement recesses 122*a* of the second hooks 122 and the coupling holes 214, 234 of the coupler 200 are smoothly aligned with each other in place.

Just after the engagement recesses 122*a* of the second hooks 122 and the coupling holes 214, 234 of the coupler 200 are aligned with each other, the actuator 260 operates to cause the pair of movable coupling pins 250 to simultaneously move from the "release position" A into the "coupling position" B, as shown in FIG. 4. At this time, as the movable coupling pins 250 are placed at the "coupling position" B, the movable coupling pins 250 are inserted into the engagement recesses 122*a* of the second hooks 122 so that the mounting brackets 100 are coupled to the coupler 200. While moving the movable coupling pins 250 from the "release position" A into the "coupling position" B, the stoppers 274 of the lock 270 are resiliently urged by the torsion spring 278 toward the "locked position" X. Therefore, as the movable coupling pins 250 are placed at the "coupling position" B, the stoppers 274 are smoothly placed at the "locked position" X to lock the movable coupling pins 250 at the "coupling position" B.

As a result, the bucket 1 can be quickly and conveniently mounted to the arm 5 of the excavator. Particularly, because the work load is not applied directly to the actuator 260 unlike in the conventional attachment coupling devices, there is no such instance that the bucket 1 is accidentally detached from the arm 5 of the excavator due to breakage of the actuator 260. Even though the hydraulic fluid of the actuator 260 leaks out or the actuator 260 is broken, the movable coupling pins 250 are locked at the "coupling position" B by means of the lock 270 and thus the bucket 1 is not detached from the excavator. Moreover, by coaxially disposing the first connecting pin 220 with the center of rotation of the bucket 1 and the fixed coupling pins 240 with the connection points of the bucket 1 and the coupler 200, the radius of rotation R3 of the bucket 1 is decreased significantly. Thus, the bucket 1 is prevented from coming into collision with the main body of the excavator and the excavating force of the bucket 1 is hardly lowered.

On the other hand, when the bucket 1 is to be detached from the excavator, the detachment operation is done in the reverse order to the aforementioned order of coupling. At this time, as shown in FIG. 5, the movable coupling pins 250 should be moved from the "locked position" X into the "release position" Z by using the lever 276 of the lock 270 before moving the movable coupling pins 250 from the "coupling position" B into the "release position" A by operating the actuator 260.

Figure 9:
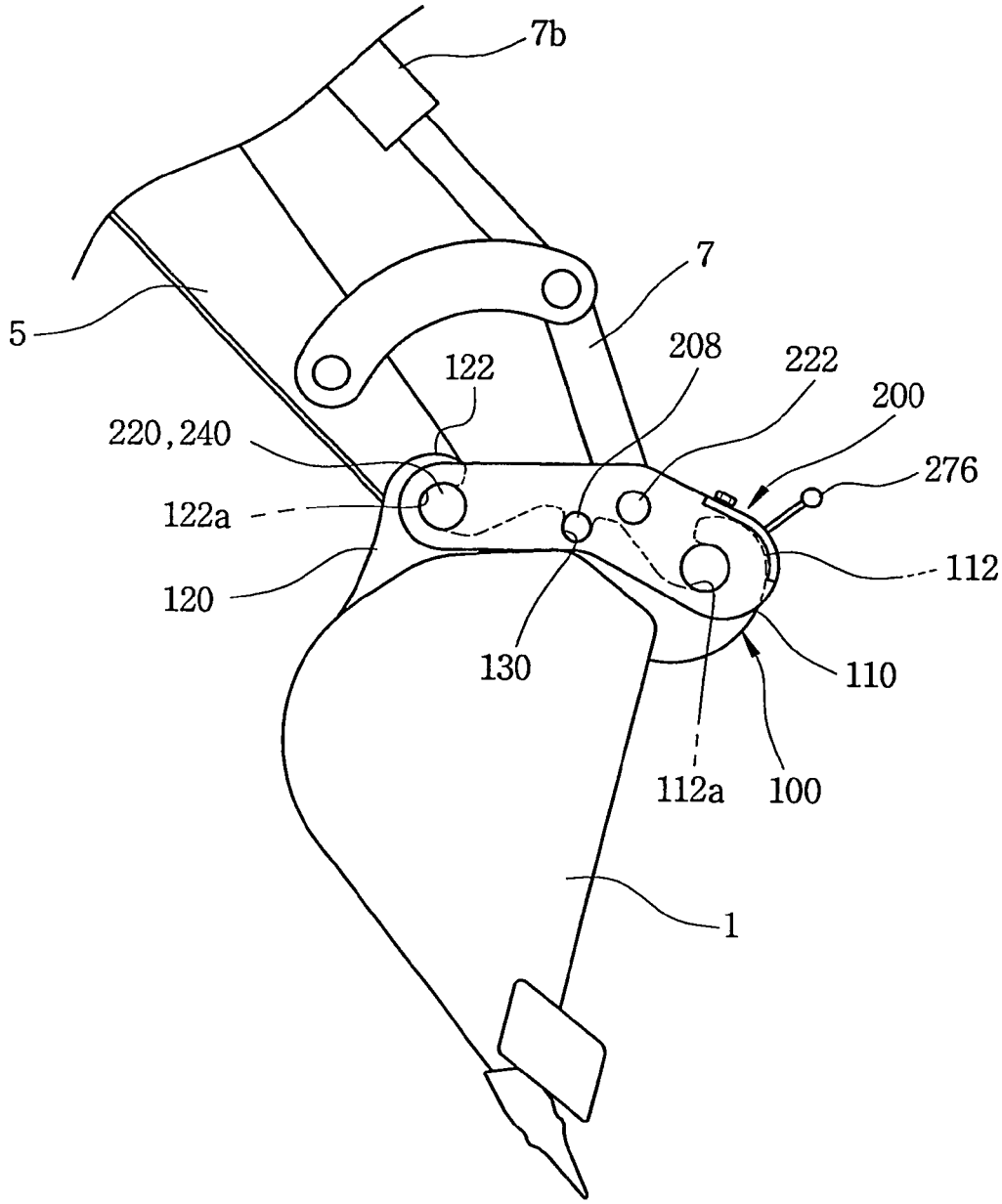
FIG. 9 is a side view illustrating another exemplary use of the attachment coupling device according to the invention.

FIG. 9 shows another use of the attachment coupling device in accordance with the invention. The bucket 1 is mounted to the arm 5 of the excavator in an inverted state by using the coupling device of the invention. The reason why the bucket 1 is to be mounted to the excavator in the inverted state is that the first and second hooks 122 of each of the mounting brackets 100 are formed symmetrically with each other with respect to the positioning recess 130 as shown in FIG. 5. The bucket 1 mounted to the arm 5 of the excavator in the inverted state is capable of performing more various excavation works.

Figure 11:
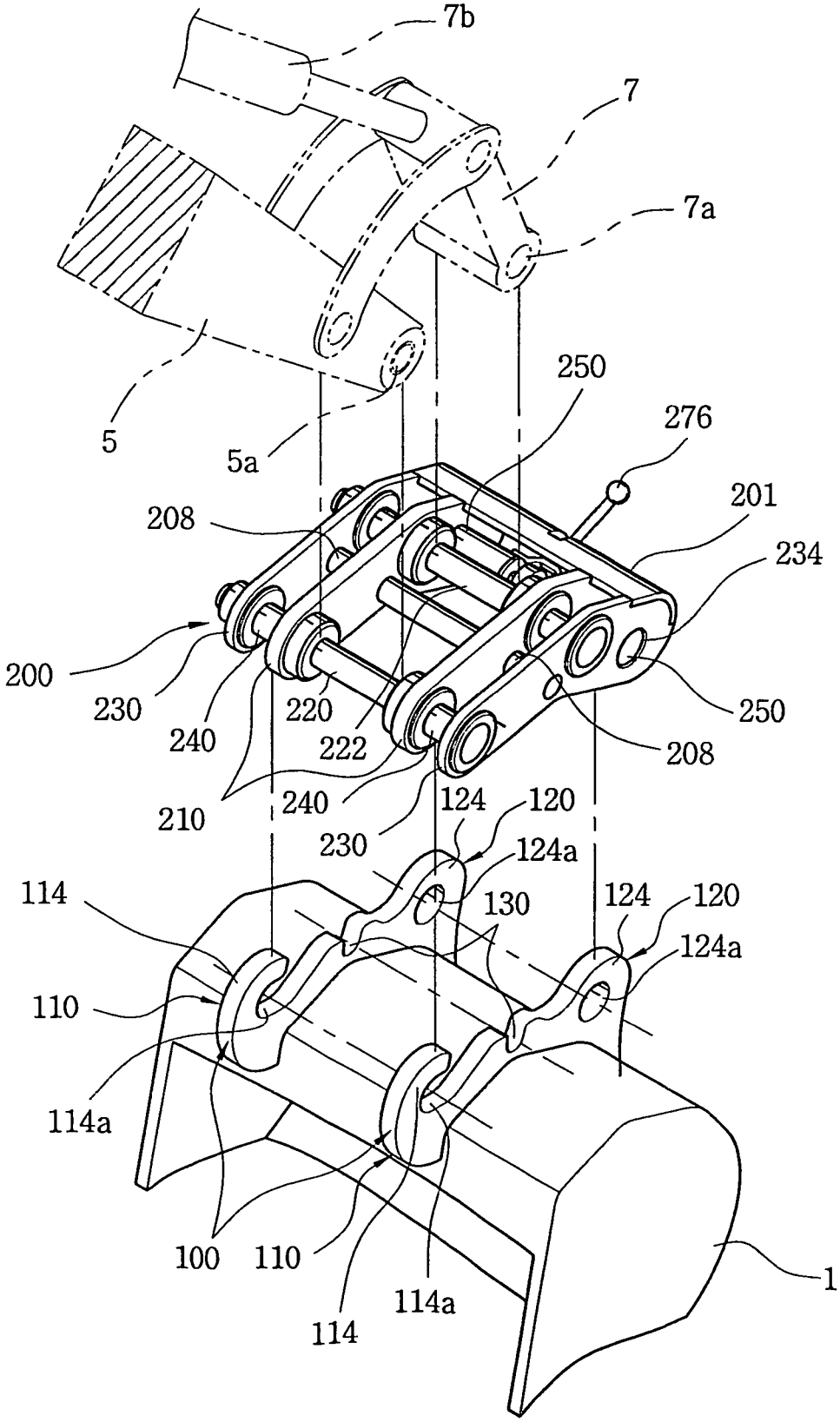
FIG. 11 is a perspective view showing an attachment coupling device according to another embodiment of the invention.

Finally, FIGS. 11 to 14 show views illustrating an attachment coupling device according to another embodiment of the present invention. The attachment coupling device according to this embodiment is constructed such that the first and second coupling portions 110, 120 of each of the mounting brackets 100 consist of a hook 114 with an engagement recess 114*a* and a coupling plate 124 with a coupling hole 124*a*, respectively, as shown in FIG. 11.

Figure 12:
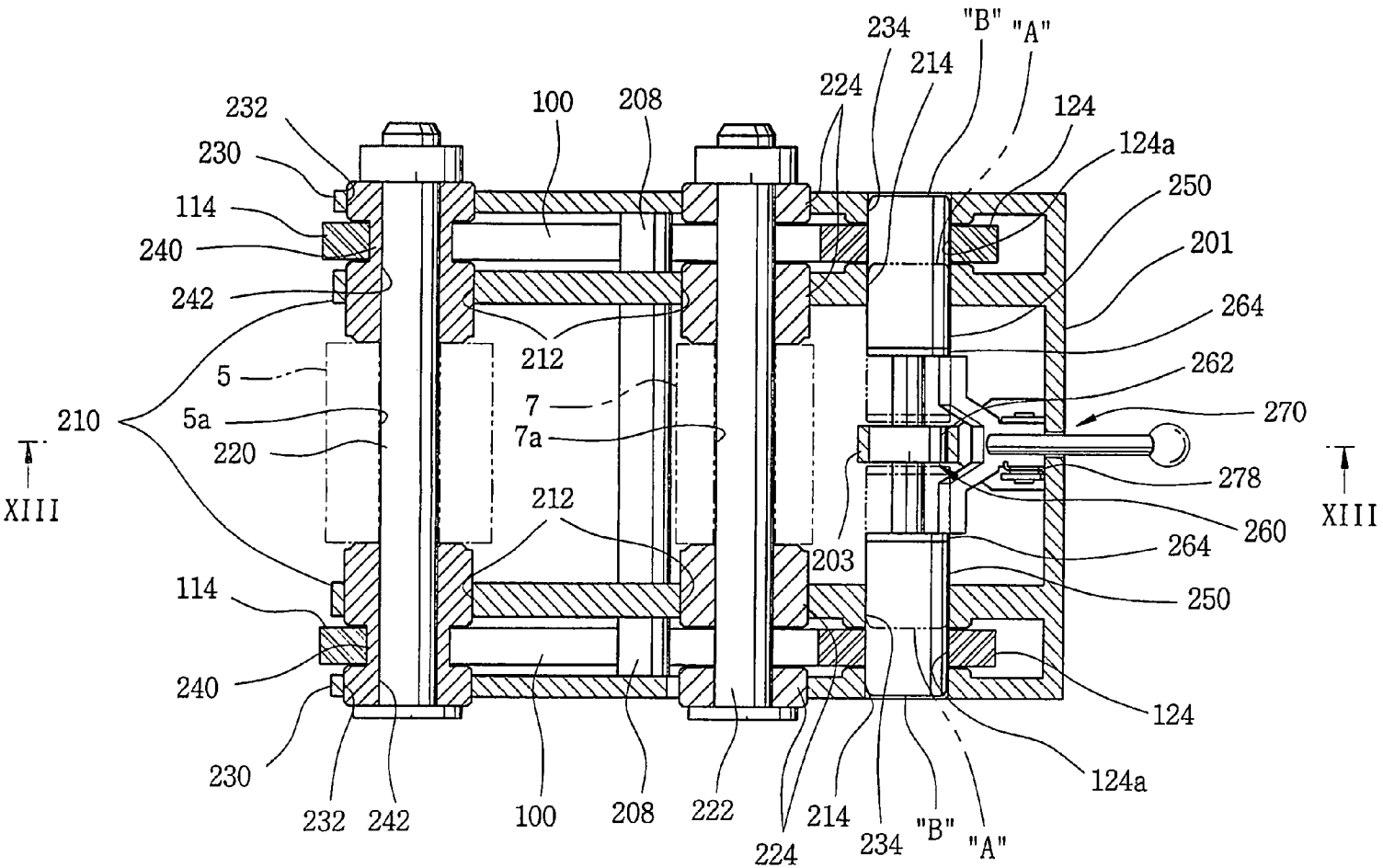
FIG. 12 is a top sectional view of a coupler constituting the attachment coupling device according to the another embodiment of the invention.

The hooks 114 and the coupling plates 124 are constructed to be engaged with the fixed coupling pins 240 and coupled to the movable coupling pins 250, respectively. Particularly, the coupling plates 124 have the coupling holes 124*a* for fixedly receiving the movable coupling pins 250 contrary to the previous embodiment in which the movable coupling pins 250 are engaged with the second hooks 122 as shown in FIG. 3. Thus, there is an advantage in that inadvertent movement of the movable coupling pins 250 is prevented so that the movable coupling pins 250 can be more firmly affixed as shown in FIG. 12.

Figure 13:
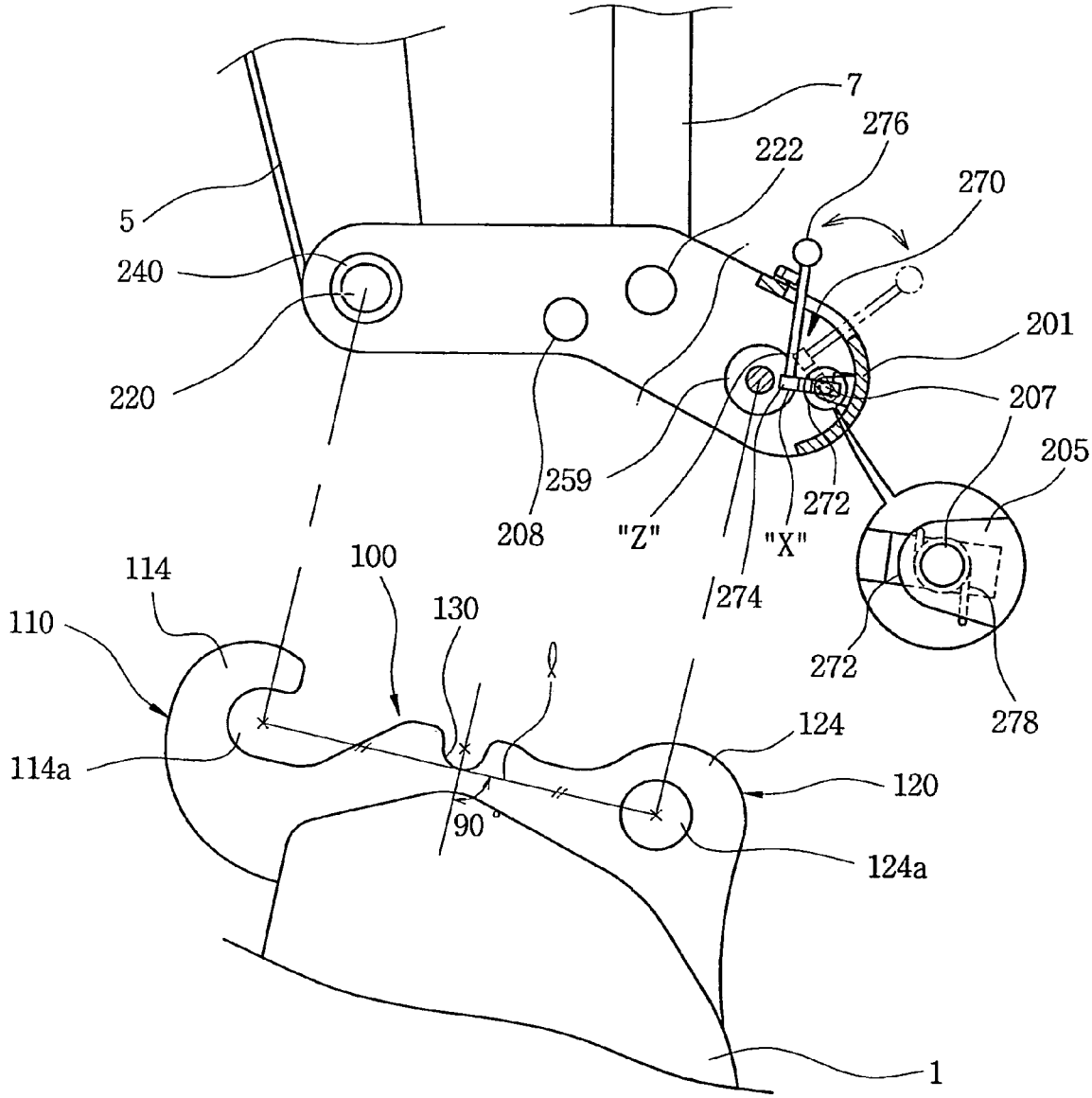
FIG. 13 is a sectional view taken along line XIII—XIII in FIG. 12.
Figure 14:
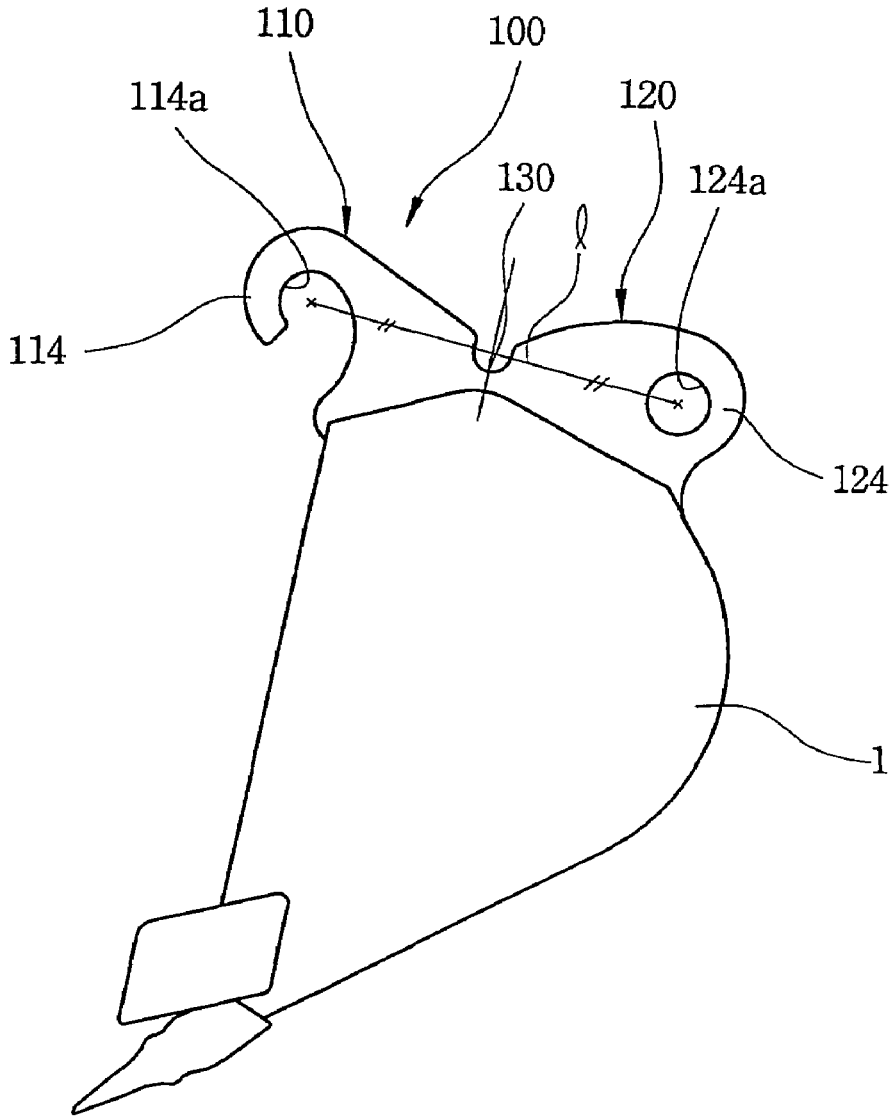
FIG. 14 is a side view showing a modified example of a mounting bracket constituting the attachment coupling device according to the another embodiment of the invention.

Although the hook 114 and the coupling plate 120 according to this embodiment is constructed to face with each other as shown in FIG. 13, it would be also possible that the hook and the coupling plate lie with each other at their backs as shown in FIG. 14. In this case, the engagement recess 114*a* formed in the hook 114 should be open outwards.

Moreover, as shown in FIG. 13, it will be apparent that the engagement recess 114*a* and the coupling hole 124*a* of the hook 114 and the coupling plate 120 according to this embodiment are symmetric with each other with respect to the positioning recess 130 of each of the mounting brackets 100.

INDUSTRIAL APPLICABILITY

As described above, the attachment coupling device of the present invention has an advantage in that the attachment can be quickly and conveniently connected to such heavy machinery as the excavators. Particularly, because the inventive attachment coupling device is constructed such that the work load is not applied directly to the actuator, the attachment can be prevented from being inadvertently detached from the heavy machinery due to breakage of the actuator. Furthermore, by coaxially disposing the center of rotation of the attachment and the connection points of the attachment and the coupler, the radius of rotation of the attachment can be reduced to a meaningful extent, thus preventing the attachment from coming into collision with the main body of the heavy machinery and improving the working capacity thereof.

What is claimed is:

1. An attachment coupling device for connecting an attachment to an arm and a push link of heavy machinery, said attachment coupling device comprising:

a pair of mounting brackets spaced apart from each other and fixedly secured to the attachment, each of the mounting brackets having first and second hooks that are aligned on an identical vertical plane; and a coupler including a pair of fixed plates secured to the arm and the push link, a pair of fixed coupling pins protruding outwardly from the fixed plates in a manner that the fixed coupling pins can be caught by the first hooks of the mounting brackets, a pair of movable coupling pins fitted to the fixed plates for linear movement between a release position and a coupling position in which the movable coupling pins come into engagement with the second hooks of the mounting brackets, and an actuator for causing the linear movement of the movable coupling pins;

wherein said coupler further comprises a lock for locking the movable coupling pins at the coupling position, said lock including a rotary body rotatable about a hinge shaft between a locked position and a release position, a pair of stoppers extending from opposite sides of the rotary body to restrict movement of the movable coupling pins at the locked position, a lever adapted to cause the rotary body to rotate, and a torsion spring for resiliently urging the rotary body toward the locked position.

2. The attachment coupling device as recited in claim 1, wherein each of said pair of mounting brackets further has a positioning recess opened upwards and located on a centerline between the first and second hooks of the mounting brackets, said first and second hooks are symmetric with each other with respect to the positioning recess, and the coupler is further provided with a pair of positioning pins engageable with the respective positioning recess of the mounting brackets.

3. An attachment coupling device for connecting an attachment to an arm and a push link of heavy machinery, said attachment coupling device comprising:

a pair of mounting brackets spaced apart from each other and fixedly secured to the attachment, each of the mounting brackets having first and second hooks that are aligned on an identical vertical plane; and a coupler including a pair of fixed plates secured to the arm and the push link, a pair of fixed coupling pins protruding outwardly from the fixed plates in a manner that the fixed coupling pins can be caught by the first hooks of the mounting brackets, a pair of movable coupling pins fitted to the fixed plates for linear movement between a release position and a coupling position in which the movable coupling pins come into engagement with the second hooks of the mounting brackets, and an actuator for causing the linear movement of the movable coupling pins;

wherein each of said pair of mounting brackets further has a positioning recess opened upwards and located on a centerline between the first and second hooks of the mounting brackets, said first and second hooks are symmetric with each other with respect to the positioning recess, and the coupler is further provided with a pair of positioning pins engageable with the respective positioning recess of the mounting brackets.

* * * * *